US007875784B2

(12) United States Patent
Moyle et al.

(10) Patent No.: US 7,875,784 B2
(45) Date of Patent: Jan. 25, 2011

(54) TUNER STRAP SENSOR

(76) Inventors: Andrew Moyle, 353 Huntly-Fosterville Rd., Bagshot Bendigo, Victoria 3551 (AU); Craig Lloyd Upfold, 48 South Tacoma Rd., South Tacoma Wyong, New South Wales 2259 (AU); Warren McAlister, 237 Cliff Drive, Katoomba, New South Wales 2100 (AU)

( * ) Notice: Subject to any disclaimer, the term of this patent is extended or adjusted under 35 U.S.C. 154(b) by 22 days.

(21) Appl. No.: 12/548,456

(22) Filed: Aug. 27, 2009

(65) Prior Publication Data

US 2009/0314153 A1 Dec. 24, 2009

Related U.S. Application Data

(63) Continuation-in-part of application No. PCT/AU2007/000213, filed on Feb. 27, 2007.

(51) Int. Cl.
*G10G 7/02* (2006.01)

(52) U.S. Cl. ..... 84/454; 84/329

(58) Field of Classification Search ..... 84/454, 84/327, 329

See application file for complete search history.

(56) References Cited

U.S. PATENT DOCUMENTS

| | | | | | |
|---|---|---|---|---|---|
| 3,691,894 | A * | 9/1972 | Schneider et al. | ..... | 84/454 |
| 4,320,689 | A * | 3/1982 | Pogoda | ..... | 84/454 |
| 4,899,636 | A * | 2/1990 | Chiba et al. | ..... | 84/454 |
| 5,633,474 | A * | 5/1997 | Cardey, III | ..... | 84/663 |
| 5,637,820 | A | 6/1997 | Wittman | | |
| 5,732,860 | A * | 3/1998 | Faraj | ..... | 224/148.2 |
| 6,031,166 | A * | 2/2000 | Petrarca | ..... | 84/327 |
| 6,140,564 | A * | 10/2000 | Pia | ..... | 84/453 |
| 6,359,203 | B1 | 3/2002 | Cronos | | |
| 6,653,542 | B2 | 11/2003 | Suzuki et al. | | |
| 6,653,543 | B2 * | 11/2003 | Kulas | ..... | 84/454 |
| 6,797,872 | B1 * | 9/2004 | Catalano et al. | ..... | 84/454 |
| 6,894,212 | B2 * | 5/2005 | Capano | ..... | 84/454 |
| 6,965,067 | B2 * | 11/2005 | Kondo | ..... | 84/455 |
| 7,049,502 | B2 * | 5/2006 | Taku et al. | ..... | 84/454 |
| 7,060,889 | B2 * | 6/2006 | Bellak | ..... | 84/741 |

(Continued)

OTHER PUBLICATIONS

Zoom 9002 Pro Operation Manual (excerpted), rendered Feb. 18, 2005, viewed Nov. 4, 2010 at http://www.zoom.co.jp/archive/Previous_Model/E_9002Pro.pdf.*

(Continued)

*Primary Examiner*—Lincoln Donovan
*Assistant Examiner*—Robert W Horn
(74) *Attorney, Agent, or Firm*—Louis Ventre, Jr.

(57) ABSTRACT

A musical instrument support strap is integrated with a tuning sensor having of a body configured at one end for attachment to the musical instrument. The body carries the pitch of a musical note struck on the musical instrument and is detected by a pickup. A printed circuit board converts the detected pitch for display on a liquid crystal display module, preferably having a needle indicator and a color indicator. The sensor may be provided independently for attachment to an existing strap. The method of using the strap for tuning a musical instrument includes attaching the musical instrument support strap to a musical instrument; striking a note on the musical instrument; reading the measurement of the frequency of vibration on the liquid crystal display module; and, adjusting the musical instrument to change the frequency of vibration.

10 Claims, 4 Drawing Sheets

U.S. PATENT DOCUMENTS

| | | | | |
|---|---|---|---|---|
| 7,074,998 | B2 | 7/2006 | Hurwicz | |
| 7,205,467 | B2 * | 4/2007 | Tafolla et al. | 84/327 |
| 7,390,951 | B2 * | 6/2008 | Dulaney et al. | 84/454 |
| 2001/0035084 | A1 * | 11/2001 | Kulas | 84/290 |
| 2009/0314153 | A1 * | 12/2009 | Moyle et al. | 84/454 |

OTHER PUBLICATIONS

Stealth Tune, Prototype of the claimed strap tuner at the 2008 NAMM show, viewed at http://www.otheroom.com/namm08/goodies.html on Nov. 4, 2010.*

Stealth Tune, for Sale viewed at http://www.otheroom.com/namm08/goodies.html on Nov. 4, 2010.*

International Search Report, International application No. PCT/AU2007/000213, filed Feb. 27, 2007, parent application of the present application, Australian Patent Office. PO Box 200, Woden Act 2606, Australia.

Paul White, "Zoom 9002 Pro", published Jul. 8, 1994, as accessed Aug. 23, 2009 at: http://web.archive. orgiweb/20050428070700/http://www.soundonsound.com/sos/1994_articles/jul94/zoom9002.html, cited is ISR of parent PCT/AU2007/000213.

* cited by examiner

TUNER STRAP SENSOR

CROSS-REFERENCE TO RELATED APPLICATIONS

This application is a continuation-in-part of Application No. PCT/AU2007/000213, filed 27 Feb. 2007, which is hereby incorporated by reference herein.

TECHNICAL FIELD

In the field of signals and indicators, a musical instrument tuning aid in the form of a musical instrument strap that measures the vibration frequency of a musical note and provides a visual indication for tuning the instrument.

BACKGROUND ART

Tuners and straps are treated as independent articles and have different functions. The tuner generally must be visible to the player of an instrument such as a guitar and in most cases be attached by way of a cable from the instrument output socket and the tuner input socket or as with acoustic type instruments; such instruments must be in audible range of the tuner.

The present invention may be used with any musical instrument capable of using a shoulder or other support strap; guitar straps provide a convenient example. Existing straps for guitars typically feature soft leather ends having a hole at each end. Each hole fits over a T-type stud, or strap pin, on the guitar. The strap may also include an adjustment clip to lengthen or shorten the strap to accommodate a person's individual comfort. Some straps have metal or plastic strap locking systems or devices attached to the strap as a way to connect the strap to the instrument. Variations of strap holes include those with a slit (a hole with a slice extending from the hole) in order easily fit over the strap pin or strap-locking connection on the guitar. Some straps come with lanyards or leather laces at one end that fit through the hole and may be used to tie to the strap to the guitar.

SUMMARY OF INVENTION

A musical instrument support strap comprises an integrated tuning sensor having of a body configured at one end with a tubular segment for attachment to the musical instrument support strap. At the opposite end of the body is a slitted hole for attachment to a musical instrument. The body is configured to transmit a frequency of vibration from a musical note received through the musical instrument support strap attached to the musical instrument. The sensor contains a liquid crystal display module that visually displays a measurement of the frequency of vibration, preferably with a needle indicator and a color indicator. The sensor contains a vibration pickup to detect the pitch of the note. The senor contains a printed circuit board configured to convert the detected pitch from the vibration pickup into a signal indication on the liquid crystal display module. The sensor may be provided independently for attachment to existing straps and may have slitted holes at both ends of the body as an option.

The method of using the sensor for tuning a musical instrument comprises steps of attaching the sensor body to a musical instrument strap in a configuration that the liquid crystal display module remains visible to a person employing the musical instrument strap; striking a note on the musical instrument; reading the measurement of the frequency of vibration on the liquid crystal display module; and, adjusting the musical instrument to change the frequency of vibration.

Technical Problem

Current musical instrument straps have only one function and that is to hold the guitar or other musical instrument. Such straps having a tuner sensor are unknown.

Tuner sensors have previously been designed to sense vibration. But these are individual devices made with a clip so that a musician can attach the tuner sensor to the headstock of the musical instrument.

Tuner sensors typically require a connection though the instrument input socket or likewise be in audible range of the instrument. Sensors and tuning indicators can also be fitted within the instrument thus generally requiring that a qualified trades-person install them and often permanently modifying the instrument. Such modifications can permanently alter the instrument, reflecting a loss of value. A headstock-clip-type tuning indicator also risks damage to the instrument, as it is typically clipped on in such a way that it protrudes from the instrument and can be inadvertently disengaged or knocked from the instrument.

No sensors enable automatic functioning, eliminate inadvertent disengagements, and offer easy viewing with the simple act of connecting a musical instrument support strap to the instrument.

Solution to Problem

The solution is in the provision of tuner sensor made as part of the musical instrument strap, or, alternatively, attached to an existing musical instrument strap prior to its attachment to a musical instrument. The present invention uses vibration-sensing technology to incorporate the tuner sensor into the strap and is enabled because the vibration from use of the instrument travels through most fabrication components of a musical instrument strap. Thus, a guitarist, for example, only needs one accessory and not two as the strap contains the tuner sensor.

In an alternative embodiment a tuner strap sensor connects to an existing musical instrument strap and to the musical instrument in such a way that it extracts and displays the frequency vibrations of notes played on the instrument by direct contact of the tuner strap sensor through the strap connection on the musical instrument.

Advantageous Effects of Invention

This invention has advantages in that the tuner sensor is mounted in or on the strap and is located in such a way as to be visible to the player while the player holds the instrument using the strap. The invention has further advantages in that it comprises a pickup, which is placed in or on the strap as part of the tuner sensor, which senses the pitch or vibration through the connection of the instrument to the strap thus avoiding the necessity of connecting the sensor though the instrument input socket or likewise be in audible range of the instrument. This invention is advantageous because it is a separable attachment to a strap and the musical instrument. This allows for an instrument strap that already exists to be converted into a tuner strap.

When the strap is connected to the instrument, the invention uses a vibration pickup that "hears" the pitch or local resonance passing through the strap from the instrument and therefore does not suffer from acoustic "cross talk" or interference from other instruments, amplifiers, etc. Hence on stage tuning is made possible, even while playing, without being affected by other audio sources.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. For example, the steps in the method of the invention may be performed in any order that results in viewing the tuner strap sensor incident to tuning a musical instrument.

Figure 5:
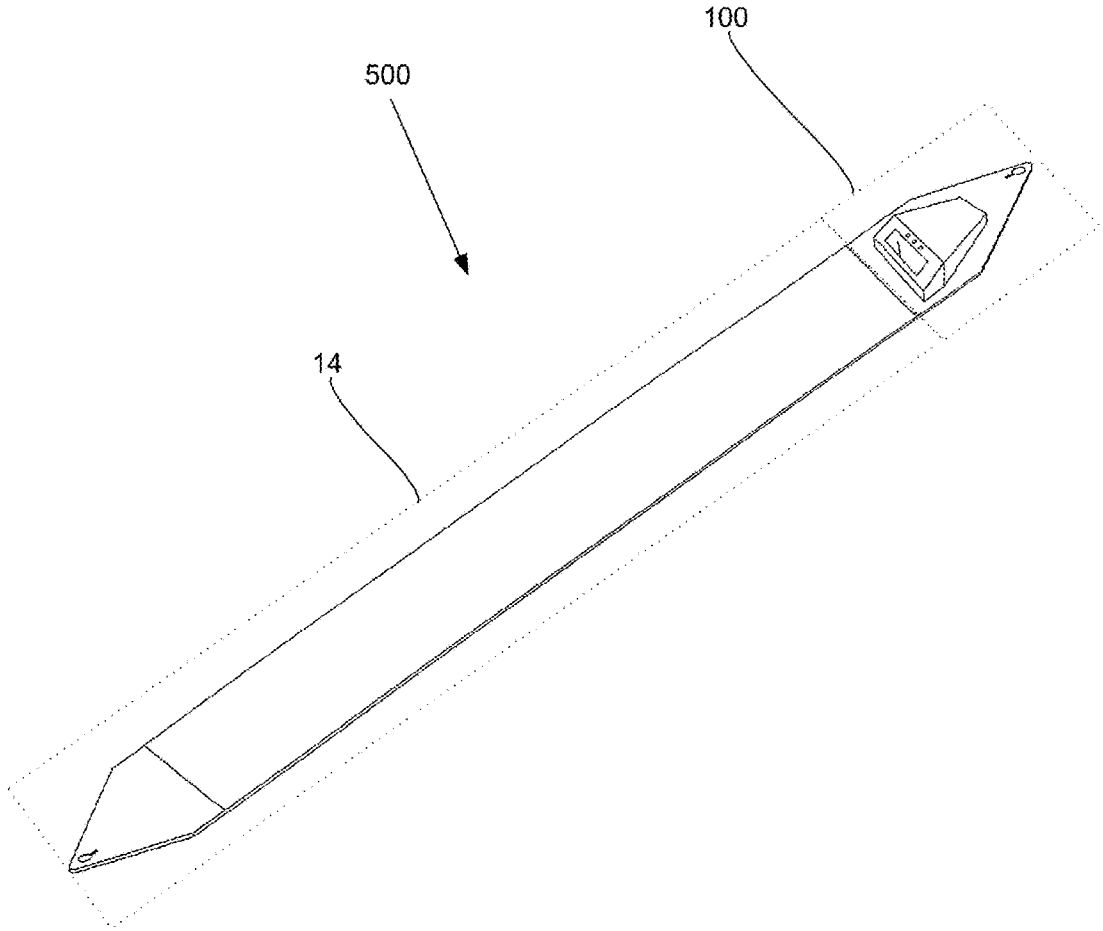
FIG. 5 is a perspective of the embodiment shown in FIG. 1 attached to an instrument strap.

The preferred embodiment of the invention is shown in FIG. 5. This is a musical instrument support strap (500) shown in two segments indicated by the dotted boxes: a musical instrument strap (14) and a tuner strap sensor defined below as the first tuner strap sensor (100).

Figure 1:
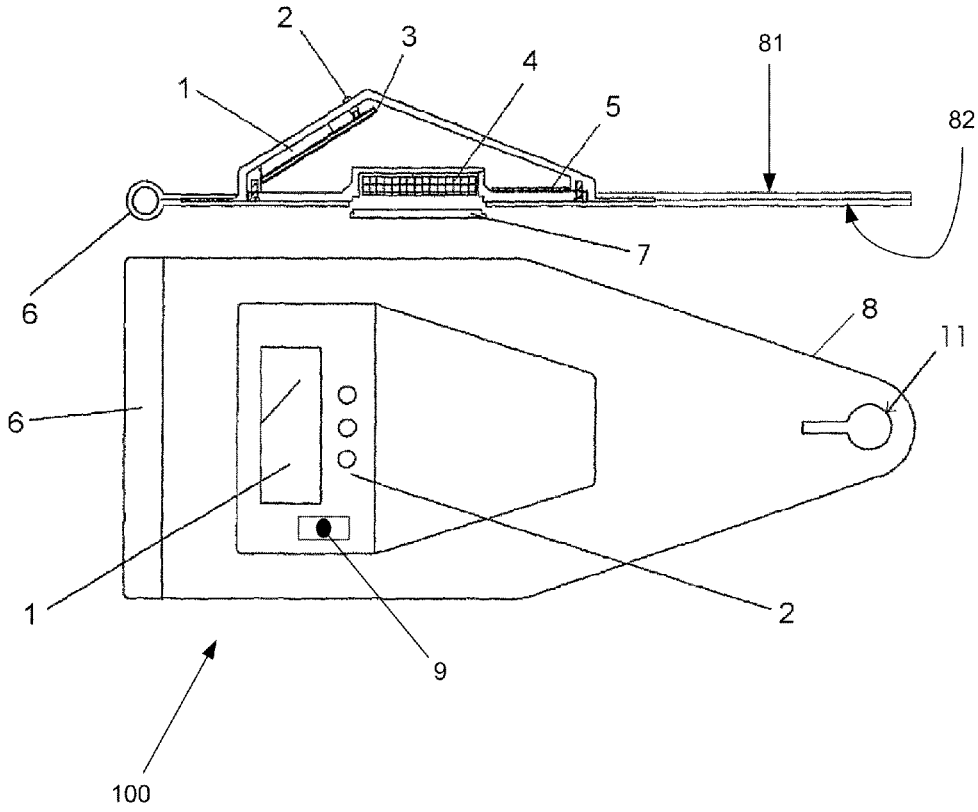
FIG. 1 is a top and side view of an embodiment of the tuner strap with a loop end prior to attachment to an instrument strap.
Figure 2:
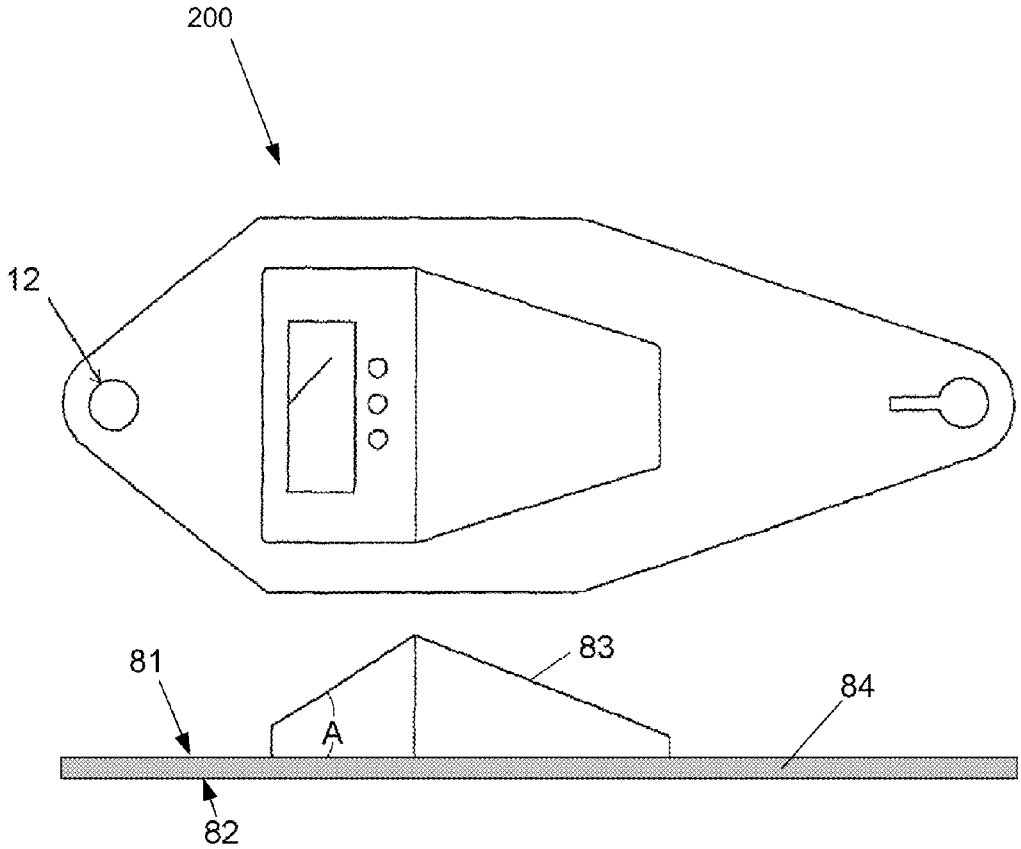
FIG. 2 is a top and side view of an embodiment of the tuner strap configured with a connection hole for attachment to an instrument strap.
Figure 4:
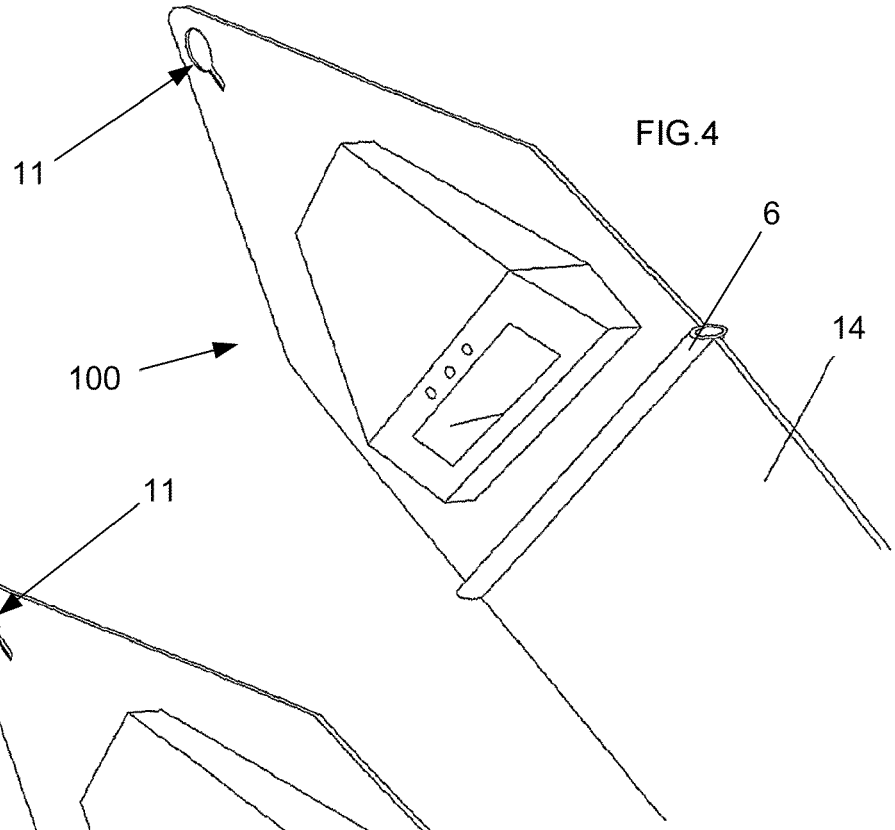
FIG. 4 is a perspective of the embodiment shown in FIG. 1 attached to an instrument strap.
Figure 3:
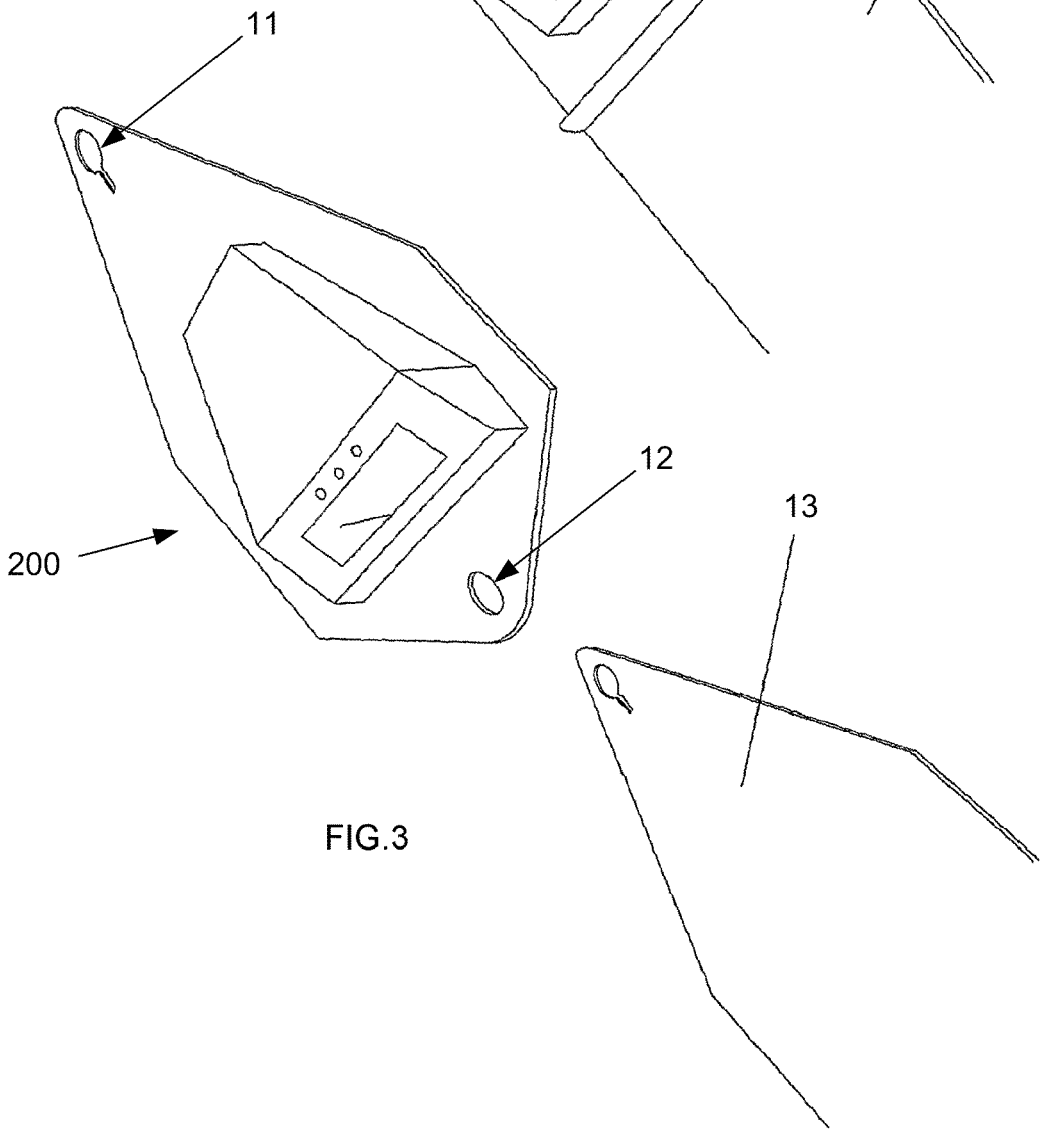
FIG. 3 is a perspective of the embodiment shown in FIG. 2 in position for attachment to an instrument strap.

FIG. 1 illustrates an embodiment of a first tuner strap sensor (100) used as an aid in tuning a musical instrument according to the invention. FIG. 2 illustrates an alternative embodiment of a second tuner strap sensor (200). These embodiments differ in the means for attaching to a musical instrument strap (14), or a slitted-hole strap (13), shown in FIGS. 3 and 4. The first tuner strap sensor (100) has a means for attaching to a musical instrument strap (14) comprising a tubular segment (6), that is a loop end. The tubular segment (6) may be used with a musical instrument strap (14) also having a looped end, which is typically sewn. A rectangular clip is preferably used to join the tubular segment (6) with the looped end of the musical instrument strap (14). Fast action locking clips, a lanyard as well as other connectors known in the art, may be employed as a means for attaching the tubular segment (6) to the musical instrument strap (14).

The second tuner strap sensor (200) has a means for attaching to a musical instrument slitted-hole type strap (13) comprising an end configuration defining a hole (12), which may be used with any common joining means such as a lanyard, preferably a leather lace. The opposite end of the body (8) has a sliced hole (11), that is, a slice extending from a hole, typically configured as a circular hole, a short distance away from the hole to enable expansion of the hole diameter to facilitate fitting the hole over a stud on a musical instrument. The remaining components of the invention are common to both embodiments and for purposes of convenience, the description hereinafter, may be limited to the first tuner strap sensor (100) with the understanding that it is equally applicable to other embodiments.

The first tuner strap sensor (100) first comprises a body (8) having a top surface (81) and a bottom surface (82). The body (8) is configured at one end with a slitted hole (11) for attachment to a musical instrument and at the opposite end with a tubular segment (6) for attachment to the musical instrument strap (14). The means for attaching to the musical instrument is a sliced hole (11).

The means for attaching to a musical instrument slitted-hole type strap (13) for the second tuner strap sensor (200) is a configuration defining a hole (12) as shown in FIG. 2.

The body (8) is configured to transmit a frequency of vibration from a musical note received through the musical instrument support strap attached to the musical instrument. The body is, thus, configured to transmit a frequency of vibration from a musical note received by direct contact of the body (8) with the strap connection on the musical instrument. The body (8) serves as a physical medium to carry the frequency of vibration directly from the musical instrument when the strap, of which it is an integral component, is connected to the musical instrument.

The first tuner strap sensor (100) next comprises a liquid crystal display module (1) attached to the top surface (81) of the body (8) and configured to visually display a measurement of the frequency of vibration. A needle is typically used to indicate the setting of the desired pitch and that of the note played on the musical instrument.

The first tuner strap sensor (100) optionally comprises a plurality of light emitting diode fine tune indicators (2). Three such light emitting diode fine tune indicators (2) are shown in all of the figures. These indicate Pitch Flat, In Tune, Pitch Sharp. If two are used, they would preferably provide an in-tune and out of tune color indication. Each of the light emitting diode fine tune indicators (2) is activated by vibration, or pitch of the musical note, and is typically configured to illuminate as a red screen for a vibration not in tune or blue screen for the correct pitch. While a useful option to allow tuning in the dark, these diodes are not essential to the invention.

The first tuner strap sensor (100) next comprises a vibration pickup (5) configured to sense the frequency of vibration in the body (8) from a musical note played on the musical instrument. The vibration pickup (5) is preferably attached near to the connecting point to the musical instrument. The instrument creates a vibration of a certain frequency when a note or string is struck. This frequency of vibration is conveyed to the strap from the musical instrument to which is connected. It is then picked up by the sensor in the strap which transmits it to the tuner which in turn converts the vibrational information, or pitch of the note, into visual information on the liquid crystal display module (1). Preferably, the vibration pickup (5) is a resonance technology that causes the tuner sensor to operate as a "true bypass" system in that no electrical connection to the musical instrument is required to operate the tuner. The tuner sensor does not rely on an audible tone and thus has preferred application to any guitar, bass or stringed instrument (electric or acoustic) that can be tuned even with the volume off.

The first tuner strap sensor (100) next comprises a printed circuit board (3) configured to convert the sensed frequency of vibration from the vibration pickup (5) into a signal indication on the liquid crystal display module (1).

The body (8) of the invention preferably has a base (84) shown in FIG. 2 as a cross-hatched area having a planar configuration. The body (8) also preferably has an elevated frame (83) rising from the top surface (81) and configured in an approximate triangular cross-sectional shape wherein a leg of the triangular cross-sectional shape of the elevated frame is configured to hold the liquid crystal display module (1) at an angle (A) of about 30 to 60 degrees from the planar configuration of the base (84).

A preferred embodiment of the invention includes a battery compartment (4) configured with a cover (7) on the bottom surface (82) of the body (8) below the elevated frame (83) and a switch (9) configured to connect and disconnect power to the vibration pickup and printed circuit board. The location below the elevated frame (83) conceals the battery compartment (4). The battery compartment (4) serves to hold batteries to power the invention.

A preferred method of using the musical instrument support strap (500) for tuning a musical instrument includes a step of attaching the musical instrument support strap (500) to a musical instrument in a configuration that the liquid crystal display module (1) remains visible to a person employing the musical instrument support strap (500).

This preferred method further includes a step of creating a musical note on the musical instrument wherein the musical note comprises a frequency of vibration. The frequency of vibration is commonly known as the pitch of the note.

This preferred method further includes a step of reading the measurement of the frequency of vibration on the liquid crystal display module. The reading step may be comprised of viewing the indicator needle on the liquid crystal display module (1) or simply seeing if the color backlight is activated, that is the background light on the liquid crystal display module (1) from the light emitting diode fine tune indicators. For example, an activated red light backlight would indicate out of tune and blue backlight would indicate a string that is in tune.

This preferred method further includes a step of adjusting the musical instrument to change the frequency of vibration. This step typically involves winding the string a little flat (to ensure the best string tension when correct tune is achieved), and then winding it back until the blue backlight kicks in.

An alternative method is used when the tuning sensor is obtained for an existing strap. This alternative method of using the sensor includes a different first step of attaching the body (8) to a musical instrument strap (14) or a slitted-hole strap (13) or other-type strap using the means for attaching as described above, which may be used with any common joining means such as a lanyard, preferably a leather lace The remaining steps in this alternative method are the same as for the preferred method described above.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the music industry and the service industry related to tuning musical instruments.

What is claimed is:

1. A musical instrument support strap comprising an integrated tuning sensor, the integrated tuning sensor comprising:

a body comprising a top surface and a bottom surface, the body configured:

at one end with a tubular segment for attachment to the musical instrument support strap, at the opposite end with a slitted hole for attachment to a musical instrument, and to transmit a frequency of vibration from a musical note received through the musical instrument support strap attached to the musical instrument;

a liquid crystal display module attached to the top surface of the body and configured to visually display a measurement of the frequency of vibration;

a vibration pickup configured to sense the frequency of vibration in the body; and, a printed circuit board configured to convert the sensed frequency of vibration from the vibration pickup into a signal indication on the liquid crystal display module.

2. The musical instrument support strap of claim 1 further comprising a plurality of light emitting diode fine tune indicators.

3. The sensor of claim 1 wherein the body further comprises a base of planar configuration; and, an elevated frame rising from the top surface and configured in an approximate triangular cross-sectional shape wherein a leg of the triangular cross-sectional shape of the elevated frame is configured to hold the liquid crystal display module at an angle of about 30 to 60 degrees from the planar configuration of the base.

4. The sensor of claim 3 further comprising a battery compartment configured with a cover on the bottom surface of the body below the elevated frame; and a switch configured to connect and disconnect power to the vibration pickup and printed circuit board.

5. A method of using the musical instrument support strap of claim 1 for tuning a musical instrument comprising the steps of:

attaching the musical instrument support strap to a musical instrument in a configuration that the liquid crystal display module remains visible to a person employing the musical instrument support strap;

creating a musical note on the musical instrument wherein the musical note comprises a frequency of vibration;

reading the measurement of the frequency of vibration on the liquid crystal display module; and, adjusting the musical instrument to change the frequency of vibration.

6. A sensor used as an aid in tuning a musical instrument comprising:

a body comprising a top surface and a bottom surface, the body configured:

at one end with a means for attaching to a musical instrument strap, at the opposite end with a means for attaching a musical instrument, and to transmit a frequency of vibration from a musical note received through the musical instrument support strap attached to the musical instrument;

a liquid crystal display module attached to the top surface of the body and configured to visually display a measurement of the frequency of vibration;

a vibration pickup configured to sense the frequency of vibration in the body; and, a printed circuit board configured to convert the sensed frequency of vibration from the vibration pickup into a signal indication on the liquid crystal display module.

7. The sensor of claim 6 further comprising a plurality of light emitting diode fine tune indicators.

8. The sensor of claim 6 wherein the body further comprises a base of planar configuration; and, an elevated frame rising from the top surface and configured in an approximate triangular cross-sectional shape wherein a leg of the triangular cross-sectional shape of the elevated frame is configured to hold the liquid crystal display module at an angle of about 30 to 60 degrees from the planar configuration of the base.

9. The sensor of claim 6 further comprising a battery compartment configured with a cover on the bottom surface of the body below the elevated frame; and a switch configured to connect and disconnect power to the vibration pickup and printed circuit board.

10. A method of using the sensor of claim 6 for tuning a musical instrument comprising the steps of:

attaching the body to a musical instrument strap using the means for attaching to a musical instrument strap;

attaching the musical instrument strap to support a musical instrument in a configuration that the liquid crystal display module remains visible to a person employing the musical instrument strap;

creating a musical note on the musical instrument wherein the musical note comprises a frequency of vibration;

reading the measurement of the frequency of vibration on the liquid crystal display module; and, adjusting the musical instrument to change the frequency of vibration.

* * * * *